US007675470B2

(12) United States Patent
Sanz et al.

(10) Patent No.: US 7,675,470 B2
(45) **Date of Patent: *Mar. 9, 2010**

(54) MULTI-BAND MONOPOLE ANTENNA FOR A MOBILE COMMUNICATIONS DEVICE

(75) Inventors: Alfonso Sanz, Barcelona (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 12/055,748

(22) Filed: Mar. 26, 2008

(65) Prior Publication Data

US 2008/0211722 A1 Sep. 4, 2008

Related U.S. Application Data

(63) Continuation of application No. 11/713,324, filed on Mar. 2, 2007, now Pat. No. 7,403,164, which is a continuation of application No. 11/124,768, filed on May 9, 2005, now Pat. No. 7,411,556, which is a continuation of application No. PCT/EP02/14706, filed on Dec. 22, 2002.

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS

| | | | |
|---|---|---|---|
| 4,123,756 | A | 10/1978 | Nagata et al. |
| 4,389,651 | A | 6/1983 | Tomasky |
| 4,578,654 | A | 3/1986 | Tait |
| 5,248,988 | A | 9/1993 | Makino |
| 5,337,065 | A | 8/1994 | Bonnet et al. |
| 5,363,114 | A | 11/1994 | Shoemaker |
| 5,457,469 | A | 10/1995 | Diamond |
| 5,572,223 | A | 11/1996 | Phillips et al. |
| 5,608,417 | A | 3/1997 | de Vall |
| 5,870,066 | A | 2/1999 | Asakura et al. |

(Continued)

FOREIGN PATENT DOCUMENTS

| | | |
|---|---|---|
| EP | 0 884 796 | 12/1998 |

(Continued)

OTHER PUBLICATIONS

C. Puente et al., "Small But Long Koch Fractal Monopole", Electronics Letters, Jan. 8, 1998, vol. 34, No. 1, pp. 9-10.

(Continued)

*Primary Examiner*—Tan Ho
(74) *Attorney, Agent, or Firm*—Winstead PC

(57) ABSTRACT

A multi-band monopole antenna for a mobile communications device includes a common conductor coupled to both a first radiating arm and a second radiating arm. The common conductor includes a feeding port for coupling the antenna to communications circuitry in a mobile communications device. In one embodiment, the first radiating arm includes a space-filling curve. In another embodiment, the first radiating arm includes a meandering section extending from the common conductor in a first direction and a contiguous extended section extending from the meandering section in a second direction.

20 Claims, 7 Drawing Sheets

U.S. PATENT DOCUMENTS

| | | | | |
|---|---|---|---|---|
| 5,929,825 | A | 7/1999 | Niu et al. | |
| 5,943,020 | A | 8/1999 | Liebendoerfer et al. | |
| 5,963,871 | A | 10/1999 | Zhinong et al. | |
| 5,986,610 | A | 11/1999 | Miron | |
| 5,990,838 | A | 11/1999 | Burns | |
| 5,990,849 | A | 11/1999 | Salvail et al. | |
| 6,011,518 | A | 1/2000 | Yamagishi et al. | |
| 6,087,990 | A | 7/2000 | Thill et al. | |
| 6,104,349 | A | 8/2000 | Cohen | |
| 6,111,545 | A | 8/2000 | Saari et al. | |
| 6,112,102 | A | 8/2000 | Zhinong et al. | |
| 6,130,651 | A * | 10/2000 | Yanagisawa et al. | 343/895 |
| 6,140,975 | A | 10/2000 | Cohen | |
| 6,166,694 | A | 12/2000 | Ying et al. | |
| 6,243,592 | B1 | 6/2001 | Nakada et al. | |
| 6,266,023 | B1 | 7/2001 | Nagy | |
| 6,271,794 | B1 | 8/2001 | Geeraert et al. | |
| 6,275,198 | B1 | 8/2001 | Kenoun et al. | |
| 6,281,846 | B1 | 8/2001 | Puente | |
| 6,307,511 | B1 | 10/2001 | Ying et al. | |
| 6,329,962 | B2 | 12/2001 | Ying et al. | |
| 6,337,663 | B1 * | 1/2002 | Chi-Ming | 343/702 |
| 6,337,667 | B1 | 1/2002 | Ayala et al. | |
| 6,343,208 | B1 | 1/2002 | Ying | |
| 6,384,790 | B2 | 5/2002 | Dishart et al. | |
| 6,445,352 | B1 | 9/2002 | Cohen | |
| 6,459,413 | B1 * | 10/2002 | Tseng et al. | 343/702 |
| 6,614,400 | B2 | 9/2003 | Egorov | |
| 6,664,930 | B2 | 12/2003 | Wen et al. | |
| 6,674,405 | B2 | 1/2004 | Wang | |
| 6,801,164 | B2 | 10/2004 | Bit-Babik | |
| 6,822,611 | B1 | 11/2004 | Kontogeorgakis et al. | |
| 6,839,040 | B2 | 1/2005 | Huber et al. | |
| 6,864,854 | B2 * | 3/2005 | Dai et al. | 343/846 |
| 6,882,320 | B2 | 4/2005 | Park et al. | |
| 6,950,071 | B2 | 9/2005 | Wen | |
| 6,963,310 | B2 | 11/2005 | Horita | |
| 6,995,720 | B2 | 2/2006 | Shikata | |
| 7,057,560 | B2 | 6/2006 | Erkocevic | |
| 7,068,230 | B2 | 6/2006 | Qi | |
| 7,069,043 | B2 | 6/2006 | Sawamura | |
| 7,081,857 | B2 * | 7/2006 | Kinnunen et al. | 343/702 |
| 7,126,537 | B2 | 10/2006 | Cohen | |
| 7,289,072 | B2 * | 10/2007 | Sakurai | 343/702 |
| 7,403,164 | B2 * | 7/2008 | Sanz et al. | 343/702 |
| 7,411,556 | B2 * | 8/2008 | Sanz et al. | 343/702 |
| 7,423,592 | B2 * | 9/2008 | Pros et al. | 343/700 MS |
| 7,511,675 | B2 | 3/2009 | Puente-Baliarda et al. | |
| 2001/0002823 | A1 | 6/2001 | Ying | |
| 2001/0050637 | A1 | 12/2001 | Aoyama et al. | |
| 2002/0000940 | A1 | 1/2002 | Moren et al. | |
| 2002/0044090 | A1 | 4/2002 | Bahr et al. | |
| 2002/0080088 | A1 | 6/2002 | Boyle | |
| 2002/0140615 | A1 | 10/2002 | Puente Baliarda | |
| 2002/0149527 | A1 | 10/2002 | Wen | |
| 2002/0175866 | A1 | 11/2002 | Gram | |
| 2002/0190904 | A1 | 12/2002 | Cohen | |
| 2003/0137459 | A1 | 7/2003 | Kim et al. | |
| 2003/0184482 | A1 | 10/2003 | Bettin | |
| 2003/0210187 | A1 | 11/2003 | Wong et al. | |
| 2004/0004574 | A1 | 1/2004 | Wen | |
| 2004/0027295 | A1 | 2/2004 | Huber et al. | |
| 2004/0095289 | A1 | 5/2004 | Bae et al. | |
| 2004/0140938 | A1 | 7/2004 | Kadambi | |
| 2004/0212545 | A1 | 10/2004 | Li | |
| 2005/0237244 | A1 | 10/2005 | Annabi et al. | |
| 2005/0259031 | A1 | 11/2005 | Sanz et al. | |
| 2006/0028380 | A1 | 2/2006 | Harano | |
| 2006/0033668 | A1 | 2/2006 | Ryu | |
| 2006/0170610 | A1 | 8/2006 | Rabinovich et al. | |
| 2007/0024508 | A1 | 2/2007 | Lee | |
| 2007/0046548 | A1 | 3/2007 | Pros et al. | |
| 2007/0103371 | A1 | 5/2007 | Kim et al. | |
| 2007/0152887 | A1 | 7/2007 | Castany et al. | |
| 2007/0152894 | A1 | 7/2007 | Sanz | |
| 2007/0152984 | A1 | 7/2007 | Ording et al. | |
| 2007/0194997 | A1 | 8/2007 | Nakanishi et al. | |

FOREIGN PATENT DOCUMENTS

| | | | |
|---|---|---|---|
| EP | 0938158 | A2 | 2/1999 |
| EP | 0938158 | | 8/1999 |
| EP | 0 986 130 | | 3/2000 |
| EP | 1011167 | | 6/2000 |
| EP | 1 091 445 | | 4/2001 |
| EP | 1 198 027 | | 4/2002 |
| EP | 0 777 293 | | 7/2002 |
| EP | 1 237 224 | | 9/2002 |
| EP | 1367671 | | 12/2003 |
| EP | 1367671 | A2 | 12/2003 |
| GB | 2 361 584 | | 10/2001 |
| JP | 62-262502 | | 11/1987 |
| JP | 10-117108 | | 5/1998 |
| JP | 10-200327 | | 7/1998 |
| JP | 10247808 | | 9/1998 |
| JP | 2001-217632 | | 8/2001 |
| JP | 2001-251128 | | 9/2001 |
| JP | 2001332924 | | 11/2001 |
| JP | 2002050919 | | 2/2002 |
| JP | 2003-347835 | | 12/2003 |
| WO | WO-96/38881 | | 12/1996 |
| WO | WO-99/56345 | | 11/1999 |
| WO | 99/67851 | A1 | 12/1999 |
| WO | 00/03451 | A1 | 1/2000 |
| WO | WO-00/77884 | | 12/2000 |
| WO | WO-01/11721 | | 2/2001 |
| WO | WO-01/26182 | | 4/2001 |
| WO | WO-01/48861 | | 7/2001 |
| WO | WO-01/54225 | | 7/2001 |
| WO | WO-02/35646 | | 5/2002 |
| WO | WO-0235652 | | 5/2002 |
| WO | 02078123 | A1 | 10/2002 |
| WO | 03034538 | A1 | 4/2003 |
| WO | 03034544 | A1 | 4/2003 |
| WO | 2004001894 | A1 | 12/2003 |
| WO | WO-2004/025778 | | 3/2004 |
| WO | 2004042868 | A1 | 5/2004 |
| WO | 2004057701 | A1 | 7/2004 |
| WO | WO-2005076409 | | 8/2005 |

OTHER PUBLICATIONS

Carles Puente Baliarda et al., "The Koch Monopole: A Small Fractal Antenna", IEEE Transactions on Antennas and Propagation, vol. 48, No. 11, Nov. 2000, pp. 1773-1781.

Nathan Cohen, "Fractal Antenna Applications in Wireless Telecommunications", IEEE, 1997, pp. 43-49.

C. Puente et al., "Multiband Properties of a Fractal Tree Antenna Generated by Electrochemical Deposition", Electronics Letters, Dec. 5, 1996, vol. 32, No. 25, pp. 2298-2299.

Sim, "An Internal Triple-band antenna for PCS/IMT-2000/Bluetooth Applications", IEEE Antennas and Wireless Propagation Letters, 2004, vol. 3.

Wong, Planar antennas for wireless communications, Wiley-Interscience, 2003.

Puente, Fractal antennas, Universitat Politècnica de Catalunya, 1997.

Puente, Multiband fractal antennas and arrays, Fractals engineering—from theory to industrial applications, 1994.

Nakano et al. Realization of dual-frequency and wide-band VSWR performances using normal-mode helical and inverted-F antennas, IEEE Transactions on Antennas and Propagation, 1998, vol. 46, No. 6.

Morishita et al., Design concept of antennas for small mobile terminals and the future perspective, IEEE Antennas and Propagation Magazine, 2002.

Dou et al, Small broadband stacked planar monopole, Willey Interscience, 2000.
Strugatsky, Multimode multiband antenna. Tactical communications: Technology in transition. Proceedings of the tactical communications conference, 1992.
Szkipala, Fractal antennas, Teat, 2001.
Poulairikas , A., Handbook of antennas in wireless communications, Lal Chand Godara, 2002.
Wimer, Michael C. USPTO Office Action for U.S. Appl. No. 10/422,578; Oct. 4, 2004.
Sauer, Joseph M. Response to the Office Action dated Oct. 4, 2004 for the U.S. Appl. No. 10/422,578; Jan. 6, 2005.
Wimer, Michael C. USPTO Office Action for U.S. Appl. No. 10/422,578; Apr. 7, 2005.
Sauer, Joseph M. Response to the Office Action dated Apr. 7, 2005 for the U.S. Appl. No. 10/422,578; May 31, 2005.
Wimer, Michael C. Advisory action before the filing of an appeal brief for U.S. Appl. No. 10/422,578; Jun. 23, 2005.
Sauer, J. Request for Continued Examination for U.S. Appl. No. 10/422,578; Aug. 8, 2005.
Wimer, Michael C. USPTO Office Action for U.S. Appl. No. 10/422,578; Aug. 24, 2005.
HTC Corp. Amended answer and counterclaim to plaintiffs amended complaint; Oct. 2, 2009.
Bhavsar, Samir A. letter to Stanley R. Moore et al. re: *Fractus* v. *Samsung et al.*; Case No. 6:09-cv-00203-LED; Oct. 28, 2009.

* cited by examiner

MULTI-BAND MONOPOLE ANTENNA FOR A MOBILE COMMUNICATIONS DEVICE

CROSS-REFERENCE TO RELATED APPLICATIONS

This patent application is a continuation application of, and incorporates by reference the entire disclosure of, U.S. patent application Ser. No. 11/713,324, which was filed on Mar. 2, 2007 now U.S. Pat. No. 7,403,164, U.S. patent application Ser. No. 11/713,324 is a continuation application of, and incorporates by reference the entire disclosure of, U.S. patent application Ser. No. 11/124,768, which was filed on May 9, 2005 now U.S. Pat. No. 7,411,556, U.S. patent application Ser. No. 11/124,768 is a continuation application of International Patent Application No. PCT/EP02/14706, filed on Dec. 22, 2002.This patent application incorporates U.S. patent application Ser. No. 11/713,324, U.S. patent application Ser. No. 11/124,768, and International Patent Application No. PCT/EP02/14706 by reference.

BACKGROUND OF THE INVENTION

1. Technical Field of the Invention

This invention relates generally to the field of multi-band monopole antennas. More specifically, a multi-band monopole antenna is provided that is particularly well-suited for use in mobile communications devices, such as Personal Digital Assistants, cellular telephones, and pagers.

2. Description of Related Art

Multi-band antenna structures for use in a mobile communications device are known in this art. For example, one type of antenna structure that is commonly utilized as an internally-mounted antenna for a mobile communication device is known as an "inverted-F" antenna. When mounted inside a mobile communications device, an antenna is often subject to problematic amounts of electromagnetic interference from other metallic objects within the mobile communications device, particularly from the ground plane. An inverted-F antenna has been shown to perform adequately as an internally mounted antenna, compared to other known antenna structures. Inverted-F antennas, however, are typically bandwidth-limited, and thus may not be well suited for bandwidth intensive applications.

SUMMARY OF THE INVENTION

A multi-band monopole antenna for a mobile communications device includes a common conductor coupled to both a first radiating arm and a second radiating arm. The common conductor includes a feeding port for coupling the antenna to communications circuitry in a mobile communications device. In one embodiment, the first radiating arm includes a space-filling curve. In another embodiment, the first radiating arm includes a meandering section extending from the common conductor in a first direction and a contiguous extended section extending from the meandering section in a second direction.

A mobile communications device having a multi-band monopole antenna includes a circuit board, communications circuitry, and the multi-band monopole antenna. The circuit board includes an antenna feeding point and a ground plane. The communications circuitry is coupled to the antenna feeding point of the circuit board. The multi-band monopole antenna includes a common conductor, a first radiating arm and a second radiating arm. The common conductor includes a feeding port that is coupled to the antenna feeding point of the circuit board. The first radiating arm is coupled to the common conductor and includes a space-filling curve. The second radiating arm is coupled to the common conductor. In one embodiment, the circuit board is mounted in a first plane within the mobile communications device and the multi-band monopole antenna is mounted in a second plane within the mobile communications device.

DETAILED DESCRIPTION OF THE DRAWINGS

Figure 1:
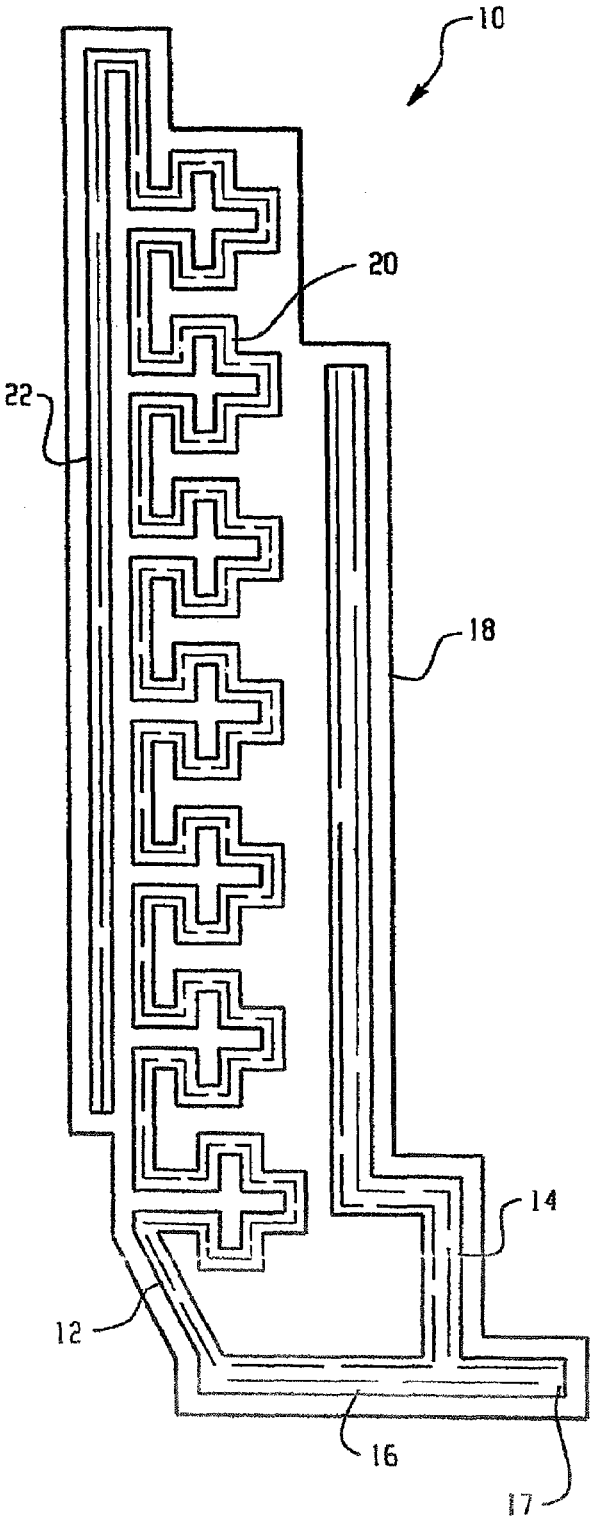
FIG. 1 is a top view of an exemplary multi-band monopole antenna for a mobile communications device.

Referring now to the drawing figures, FIG. 1 is a top view of an exemplary multi-band monopole antenna 10 for a mobile communications device. The multi-band monopole antenna 10 includes a first radiating arm 12 and a second radiating arm 14 that are both coupled to a feeding port 17 through a common conductor 16. The antenna 10 also includes a substrate material 18 on which the antenna structure 12, 14, 16 is fabricated, such as a dielectric substrate, a flex-film substrate, or some other type of suitable substrate material. The antenna structure 12, 14, 16 is preferably patterned from a conductive material, such as a metallic thick-film paste that is printed and cured on the substrate material 18, but may alternatively be fabricated using other known fabrication techniques.

The first radiating arm 12 includes a meandering section 20 and an extended section 22. The meandering section 20 is coupled to and extends away from the common conductor 16. The extended section 22 is contiguous with the meandering section 20 and extends from the end of the meandering section 20 back towards the common conductor 16. In the illustrated embodiment, the meandering section 20 of the first radiating arm 12 is formed into a geometric shape known as a space-filling curve, in order to reduce the overall size of the antenna 10. A space-filling curve is characterized by at least ten segments which are connected in such a way that each segment forms an angle with its adjacent segments, that is, no pair of adjacent segments define a larger straight segment. It should be understood, however, that the meandering section 20 may include other space-filling curves than that shown in FIG. 1, or may optionally be arranged in an alternative meandering geometry. FIGS. 2-6, for example, illustrate antenna structures having meandering sections formed from several alternative geometries. The use of shape-filling curves to form antenna structures is described in greater detail in the co-owned PCT Application WO 01/54225, entitled Space-Filling Miniature Antennas, which is hereby incorporated into the present application by reference.

The second radiating arm 14 includes three linear portions. As viewed in FIG. 1, the first linear portion extends in a vertical direction away from the common conductor 16. The second linear portion extends horizontally from the end of the first linear portion towards the first radiating arm. The third linear portion extends vertically from the end of the second linear portion in the same direction as the first linear portion and adjacent to the meandering section 20 of the first radiating arm 14.

Figure 10:
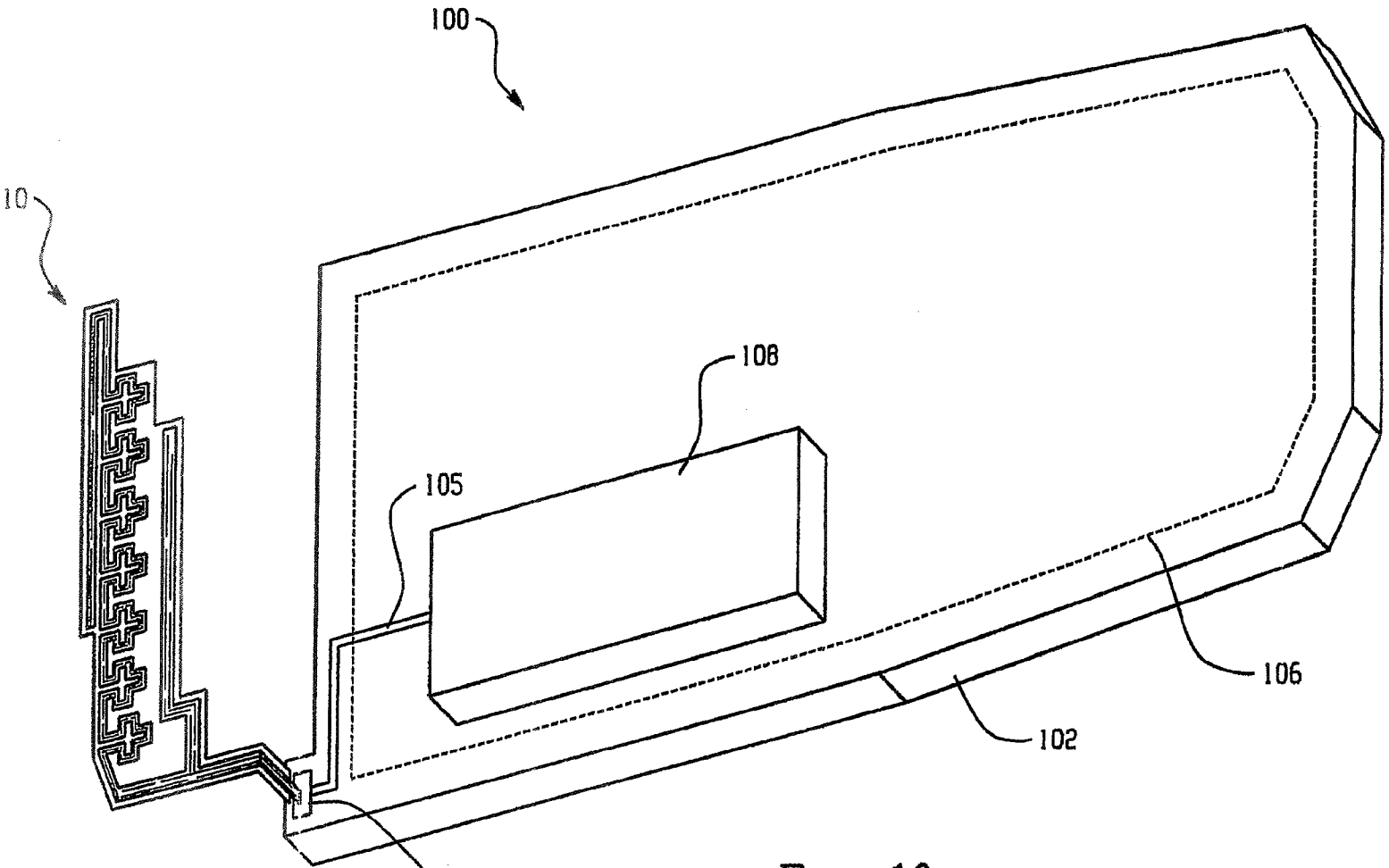
FIG. 10 is a top view of the exemplary multi-band monopole antenna of FIG. 1 coupled to a circuit board for a mobile communications device.

As noted above, the common conductor 16 of the antenna 10 couples the feeding port 17 to the first and second radiating arms 12, 14. The common conductor 16 extends horizontally (as viewed in FIG. 1) beyond the second radiating arm 14, and may be folded in a perpendicular direction (perpendicularly into the page), as shown in FIG. 10, in order to couple the feeding port 17 to communications circuitry in a mobile communications device.

Operationally, the first and second radiating arms 12, 14 are each tuned to a different frequency band, resulting in a dual-band antenna. The antenna 10 may be tuned to the desired dual-band operating frequencies of a mobile communications device by pre-selecting the total conductor length of each of the radiating arms 12, 14. For example, in the illustrated embodiment, the first radiating arm 12 may be tuned to operate in a lower frequency band or groups of bands, such as PDC (800 MHz), CDMA (800 MHz), GSM (850 MHz), GSM (900 MHz), GPS, or some other desired frequency band. Similarly, the second radiating arm 14 may be tuned to operate in a higher frequency band or group of bands, such as GPS, PDC (1500 MHz), GSM (1800 MHz), Korean PCS, CDMA/PCS (1900 MHz), CDMA2000/UMTS, IEEE 802.11 (2.4 GHz), or some other desired frequency band. It should be understood that, in some embodiments, the lower frequency band of the first radiating arm 12 may overlap the higher frequency band of the second radiating ann 14, resulting in a single broader band. It should also be understood that the multi-band antenna 10 may be expanded to include further frequency bands by adding additional radiating arms. For example, a third radiating arm could be added to the antenna 10 to form a tri-band antenna.

Figure 2:
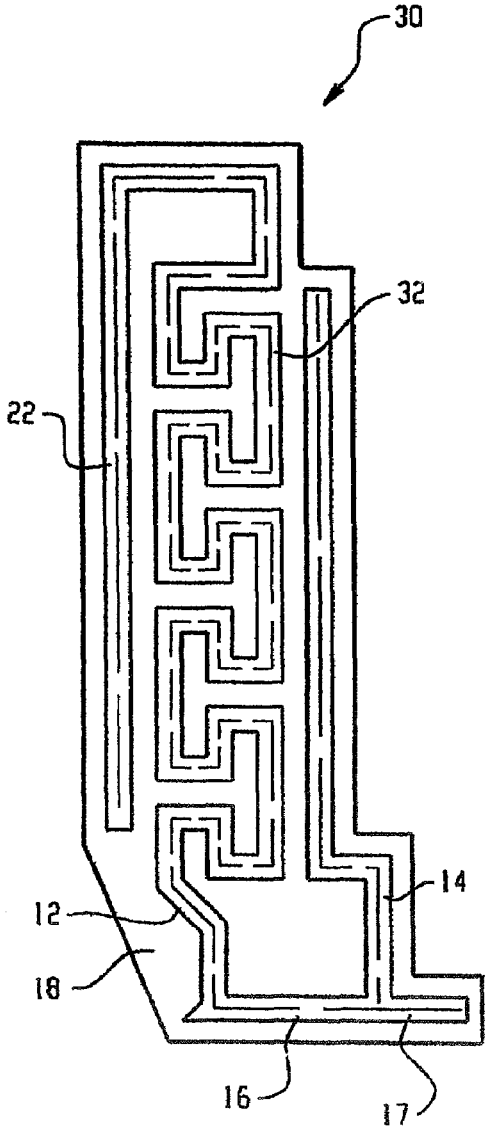
FIG. 2 is a top view of an exemplary multi-band monopole antenna including one alternative space-filling geometry.

FIG. 2 is a top view of an exemplary multi-band monopole antenna 30 including one alternative space-filling geometry. The antenna 30 show in FIG. 2 is similar to the multi-band antenna 10 shown in FIG. 1, except the meandering section 32 in the first radiating arm 12 includes a different space-filling curve than that shown in FIG. 1.

FIGS. 3-9 illustrate several alternative multi-band monopole antenna configurations 50, 70, 80, 90, 93, 95, 97. Similar to the antennas 10, 30 shown in FIGS. 1 and 2, the multi-band monopole antenna 50 illustrated in FIG. 3 includes a common conductor 52 coupled to a first radiating arm 54 and a second radiating arm 56. The common conductor 52 includes a feeding port 62 on a linear portion of the common conductor 52 that extends horizontally (as viewed in FIG. 3) away from the radiating arms 54, 56, and that may be folded in a perpendicular direction (perpendicularly into the page) in order to couple the feeding port 62 to communications circuitry in a mobile communications device.

The first radiating arm 54 includes a meandering section 58 and an extended section 60. The meandering section 58 is coupled to and extends away from the common conductor 52. The extended section 60 is contiguous with the meandering section 58 and extends from the end of the meandering section 58 in an arcing path back towards the common conductor 52.

The second radiating arm 56 includes three linear portions. As viewed in FIG. 3, the first linear portion extends diagonally away from the common conductor 52. The second linear portion extends horizontally from the end of the first linear portion towards the first radiating arm. The third linear portion extends vertically from the end of the second linear portion away from the common conductor 52 and adjacent to the meandering section 58 of the first radiating arm 54.

Figure 3:
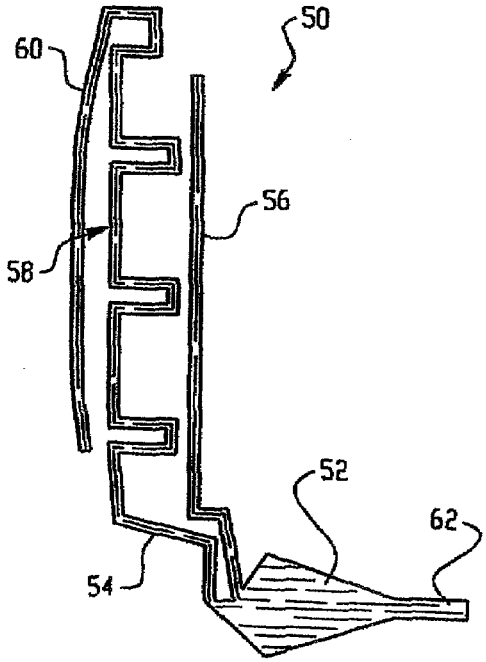
FIGS. 3-9 illustrate several alternative multi-band monopole antenna configurations.
Figure 4:
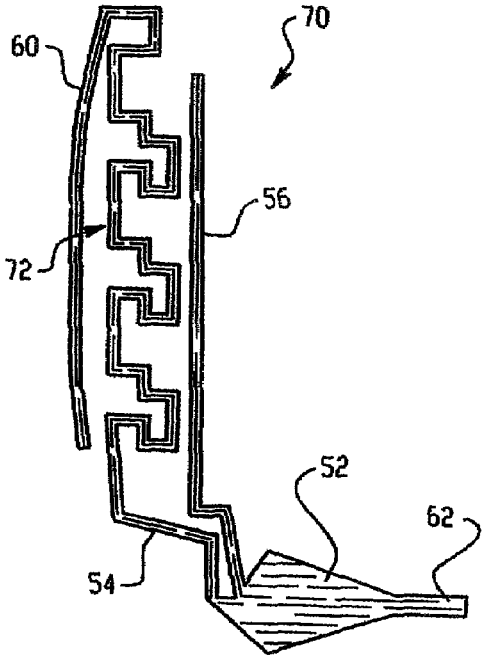
Figure 5:
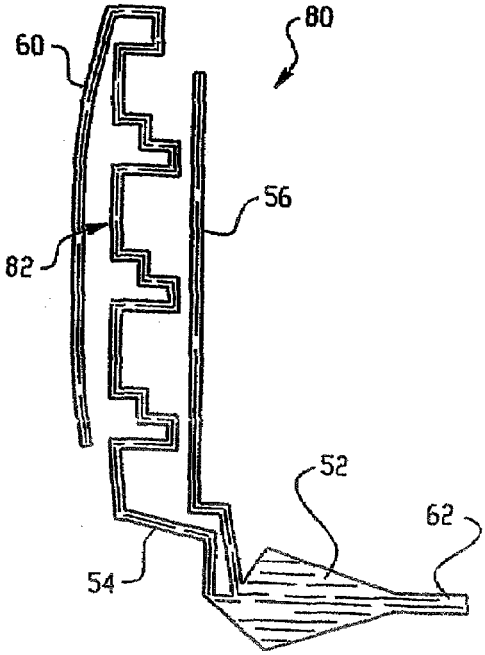
Figure 6:
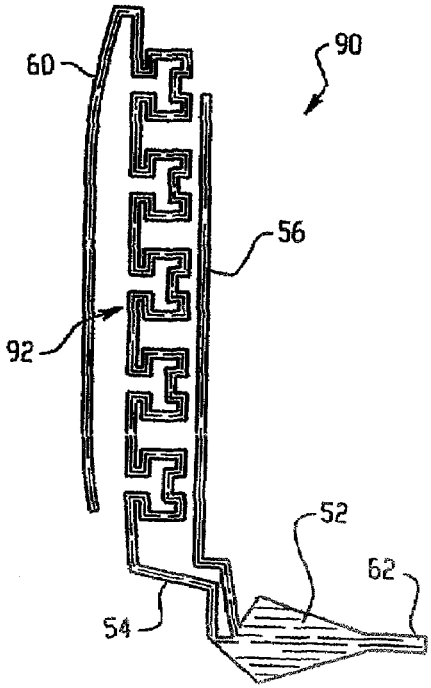

The multi-band monopole antennas 70, 80, 90 illustrated in FIGS. 4-6 are similar to the antenna 50 shown in FIG. 3, except each includes a differently-patterned meandering portion 72, 82, 92 in the first radiating arm 54. For example, the meandering portion 92 of the multi-band antenna 90 shown in FIG. 6 meets the definition of a space-filling curve, as described above. The meandering portions 58, 72, 82 illustrated in FIGS. 3-5, however, each include differently-shaped periodic curves that do not meet the requirements of a space-filling curve.

Figure 9:
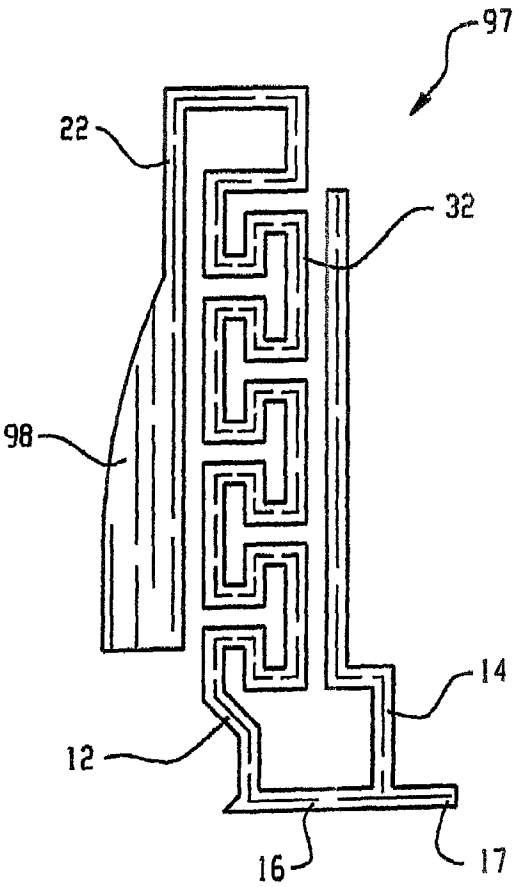
Figure 8:
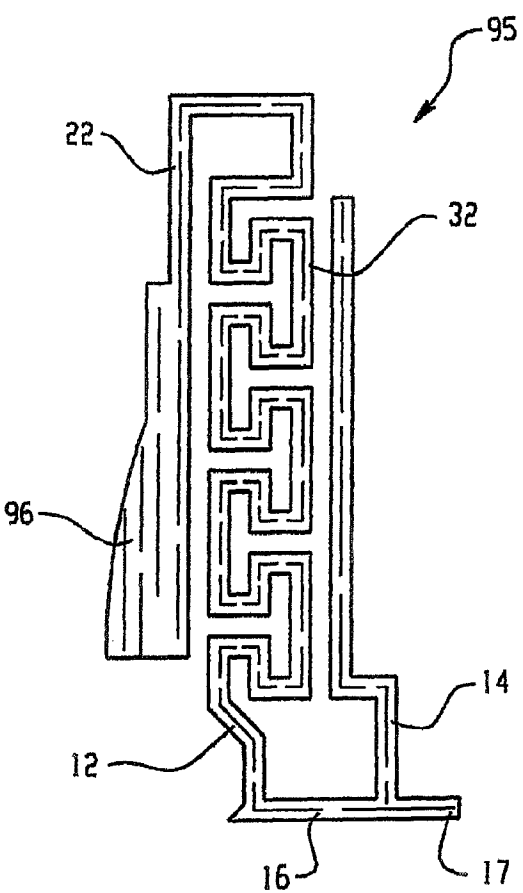
Figure 7:
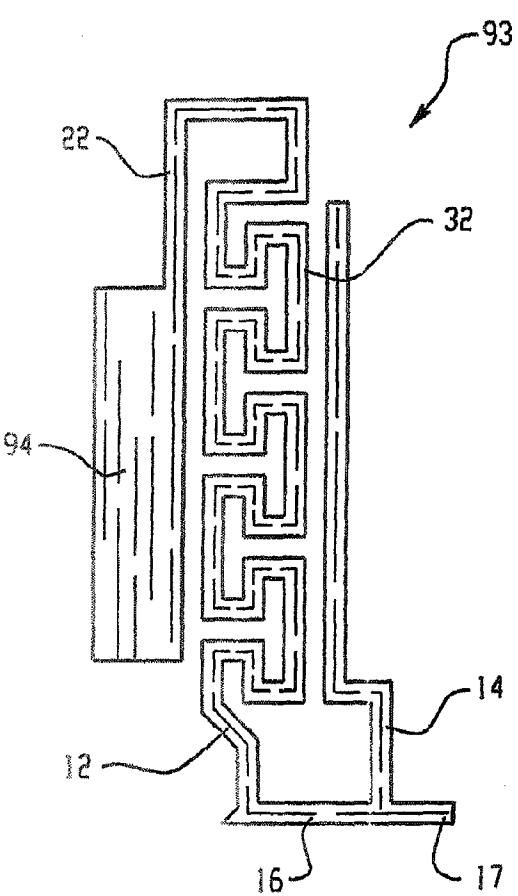

The multi-band monopole antennas 93, 95, 97 illustrated in FIGS. 7-9 are similar to the antenna 30 shown in FIG. 2, except in each of FIGS. 7-9 the expanded portion 22 of the first radiating arm 12 includes an additional area 94, 96, 98. In FIG. 7, the expanded portion 22 of the first radiating arm 12 includes a polygonal portion 94. In FIGS. 8 and 9, the expanded portion 22 of the first radiating arm 12 includes a portion 96, 98 with an arcuate longitudinal edge.

FIG. 10 is a top view 100 of the exemplary multi-band monopole antenna 10 of FIG. 1 coupled to the circuit board 102 of a mobile communications device. The circuit board 102 includes a feeding point 104 and a ground plane 106. The ground plane 106 may, for example, be located on one of the surfaces of the circuit board 102, or may be one layer of a multi-layer printed circuit board. The feeding point 104 may, for example, be a metallic bonding pad that is coupled to circuit traces 105 on one or more layers of the circuit board 102. Also illustrated, is communication circuitry 108 that is coupled to the feeding point 104. The communication circuitry 108 may, for example, be a multi-band transceiver circuit that is coupled to the feeding point 104 through circuit traces 105 on the circuit board.

In order to reduce electromagnetic interference from the ground plane 106, the antenna 10 is mounted within the mobile communications device such that the projection of the antenna footprint on the plane of the circuit board 102 does not intersect the metalization of the ground plane 106 by more than fifty percent. In the illustrated embodiment 100, the antenna 10 is mounted above the circuit board 102. That is, the circuit board 102 is mounted in a first plane and the antenna 10 is mounted in a second plane within the mobile communications device. In addition, the antenna 10 is laterally offset from an edge of the circuit board 102, such that, in this embodiment 100, the projection of the antenna footprint on the plane of the circuit board 102 does not intersect any of the metalization of the ground plane 106.

In order to further reduce electromagnetic interference from the ground plane 106, the feeding point 104 is located at a position on the circuit board 102 adjacent to a corner of the ground plane 106. The antenna 10 is preferably coupled to the feeding point 104 by folding a portion of the common conductor 16 perpendicularly towards the plane of the circuit board 102 and coupling the feeding port 17 of the antenna 10 to the feeding point 104 of the circuit board 102. The feeding port 17 of the antenna 10 may, for example, be coupled to the feeding point 104 using a commercially available connector, by bonding the feeding port 17 directly to the feeding point 104, or by some other suitable coupling means. In other embodiments, however, the feeding port 17 of the antenna 10 may be coupled to the feeding point 104 by some means other than folding the common conductor 16.

Figure 11:
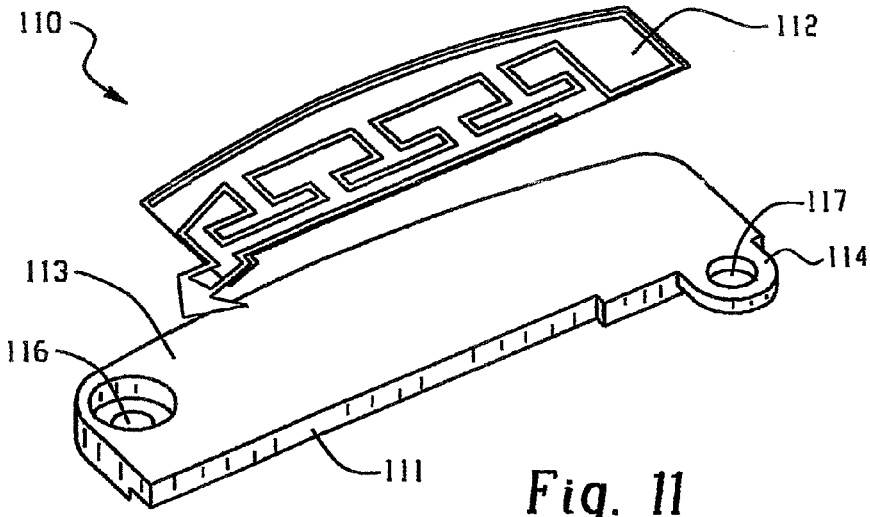
FIG. 11 shows an exemplary mounting structure for securing a multi-band monopole antenna within a mobile communications device.

FIG. 11 shows an exemplary mounting structure 111 for securing a multi-band monopole antenna 112 within a mobile communications device. The illustrated embodiment 110 employs a multi-band monopole antenna 112 having a meandering section similar to that shown in FIG. 2. It should be understood, however, that alternative multi-band monopole antenna configurations, as described in FIGS. 1-9, could also be used.

The mounting structure 111 includes a flat surface 113 and at least one protruding section 114. The antenna 112 is secured to the flat surface 113 of the mounting structure 111, preferably using an adhesive material. For example, the antenna 112 may be fabricated on a flex-film substrate having a peel-type adhesive on the surface opposite the antenna structure. Once the antenna 112 is secured to the mounting structure 111, the mounting structure 111 is positioned in a mobile communications device with the protruding section 114 extending over the circuit board. The mounting structure 111 and antenna 112 may then be secured to the circuit board and to the housing of the mobile communications device using one or more apertures 116, 117 within the mounting structure 111.

Figure 12:
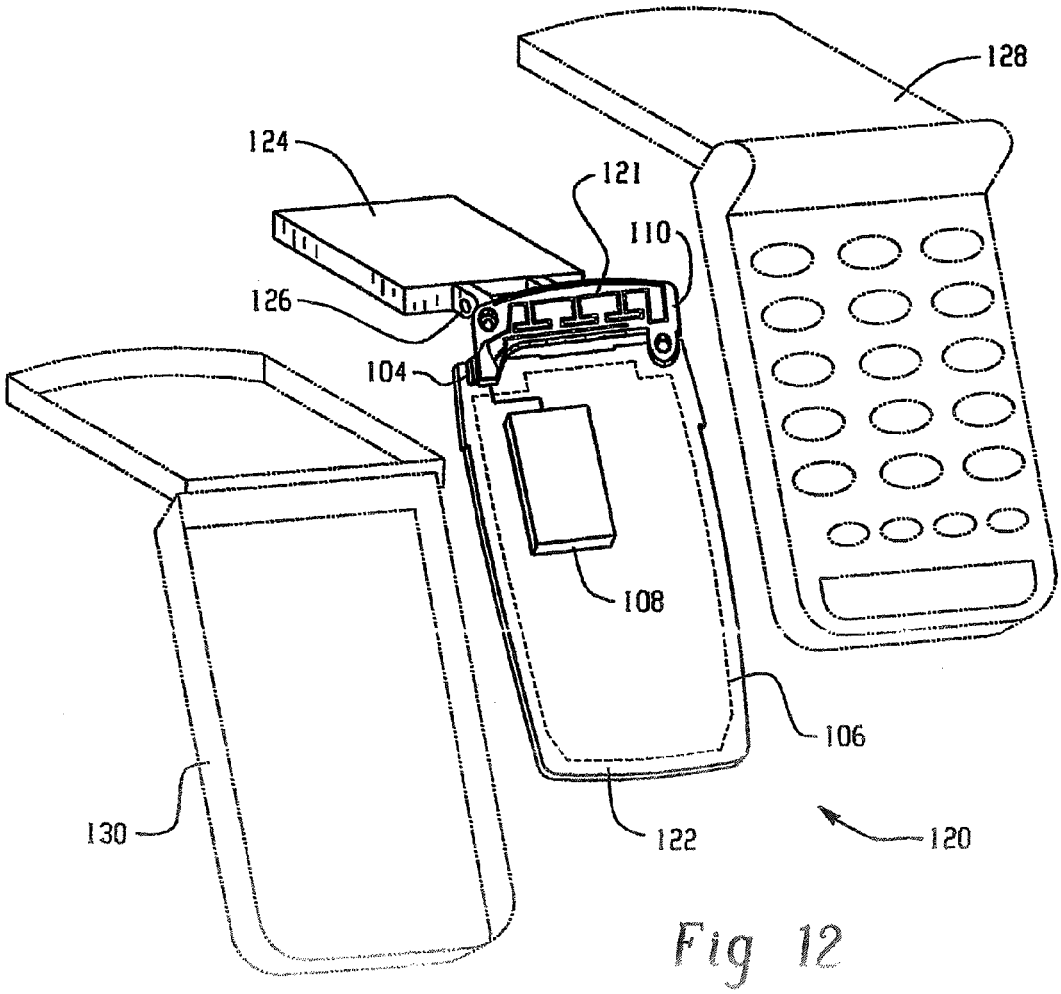
FIG. 12 is an exploded view of an exemplary clamshell-type cellular telephone having a multi-band monopole antenna.

FIG. 12 is an exploded view of an exemplary clamshell-type cellular telephone 120 having a multi-band monopole antenna 121. The cellular telephone 120 includes a lower circuit board 122, an upper circuit board 124, and the multi-band antenna 121 secured to a mounting structure 110. Also illustrated are an upper and a lower housing 128, 130 that join to enclose the circuit boards 122, 124 and antenna 121. The illustrated multi-band monopole antenna 121 is similar to the multi-band antenna 30 shown in FIG. 2. It should be understood, however, that alternative antenna configurations, as described above with reference to FIGS. 1-9, could also be used.

The lower circuit board 122 is similar to the circuit board 102 described above with reference to FIG. 10, and includes a ground plane 106, a feeding point 104, and communications circuitry 108. The multi-band antenna 121 is secured to a mounting structure 110 and coupled to the lower circuit board 122, as described above with reference to FIGS. 10 and 11. The lower circuit board 122 is then connected to the upper circuit board 124 with a hinge 126, enabling the upper and lower circuit boards 122, 124 to be folded together in a manner typical for clamshell-type cellular phones. In order to further reduce electromagnetic interference from the upper and lower circuit boards 122, 124, the multi-band antenna 121 is preferably mounted on the lower circuit board 122 adjacent to the hinge 126.

Figure 13:
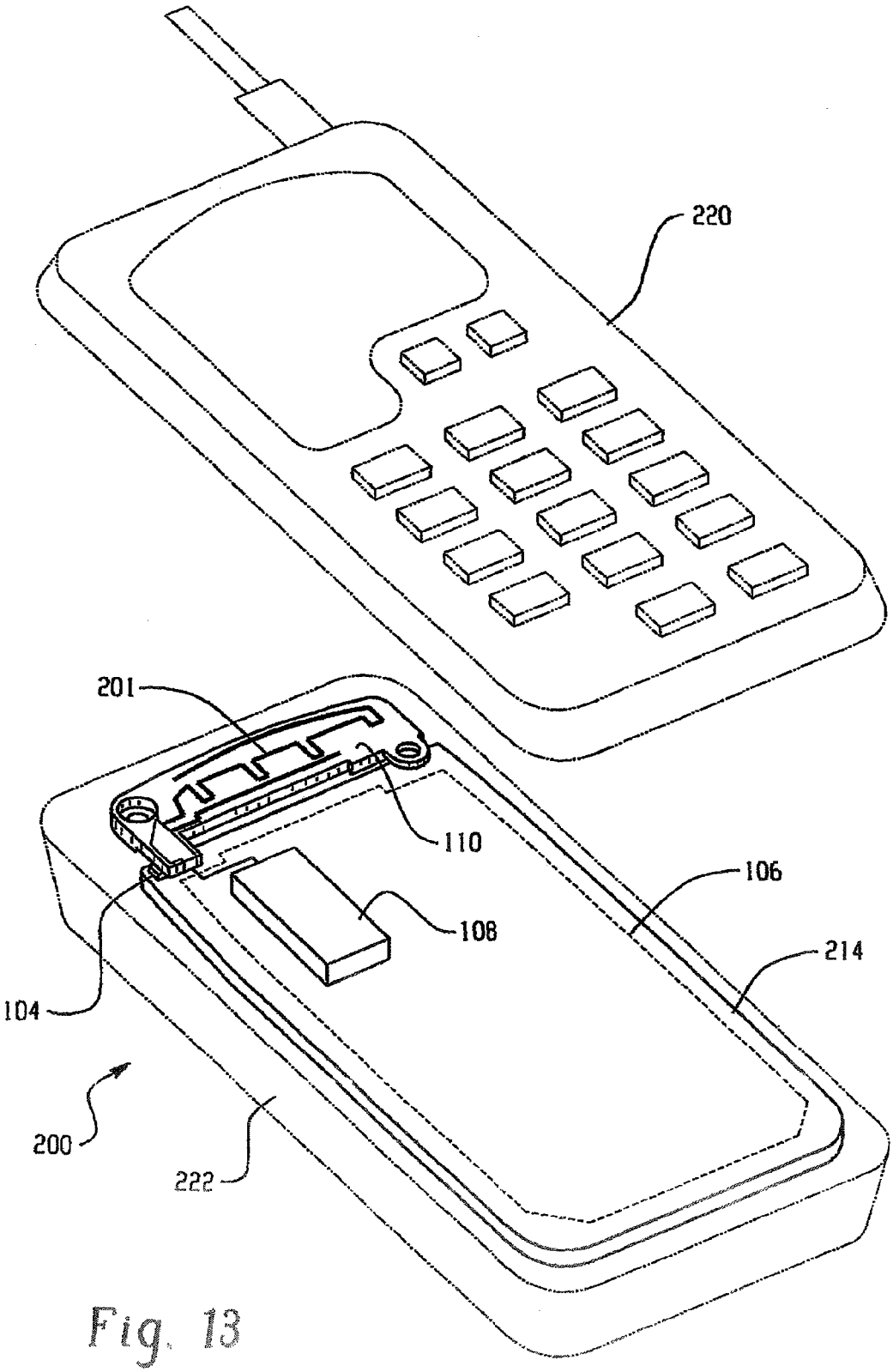
FIG. 13 is an exploded view of an exemplary candy-bar-style cellular telephone having a multi-band monopole antenna.

FIG. 13 is an exploded view of an exemplary candy-bar-type cellular telephone 200 having a multi-band monopole antenna 201. The cellular telephone 200 includes the multi-band monopole antenna 201 secured to a mounting structure 110, a circuit board 214, and an upper and lower housing 220, 222. The circuit board 214 is similar to the circuit board 102 described above with reference to FIG. 10, and includes a ground plane 106, a feeding point 104, and communications circuitry 108. The illustrated antenna 201 is similar to the multi-band monopole antenna shown in FIG. 3, however alternative antenna configurations, as described above with reference to FIGS. 1-9, could also be used.

The multi-band antenna 201 is secured to the mounting structure 110 and coupled to the circuit board 214 as described above with reference to FIGS. 10 and 11. The upper and lower housings 220, 222 are then joined to enclose the antenna 212 and circuit board 214.

Figure 14:
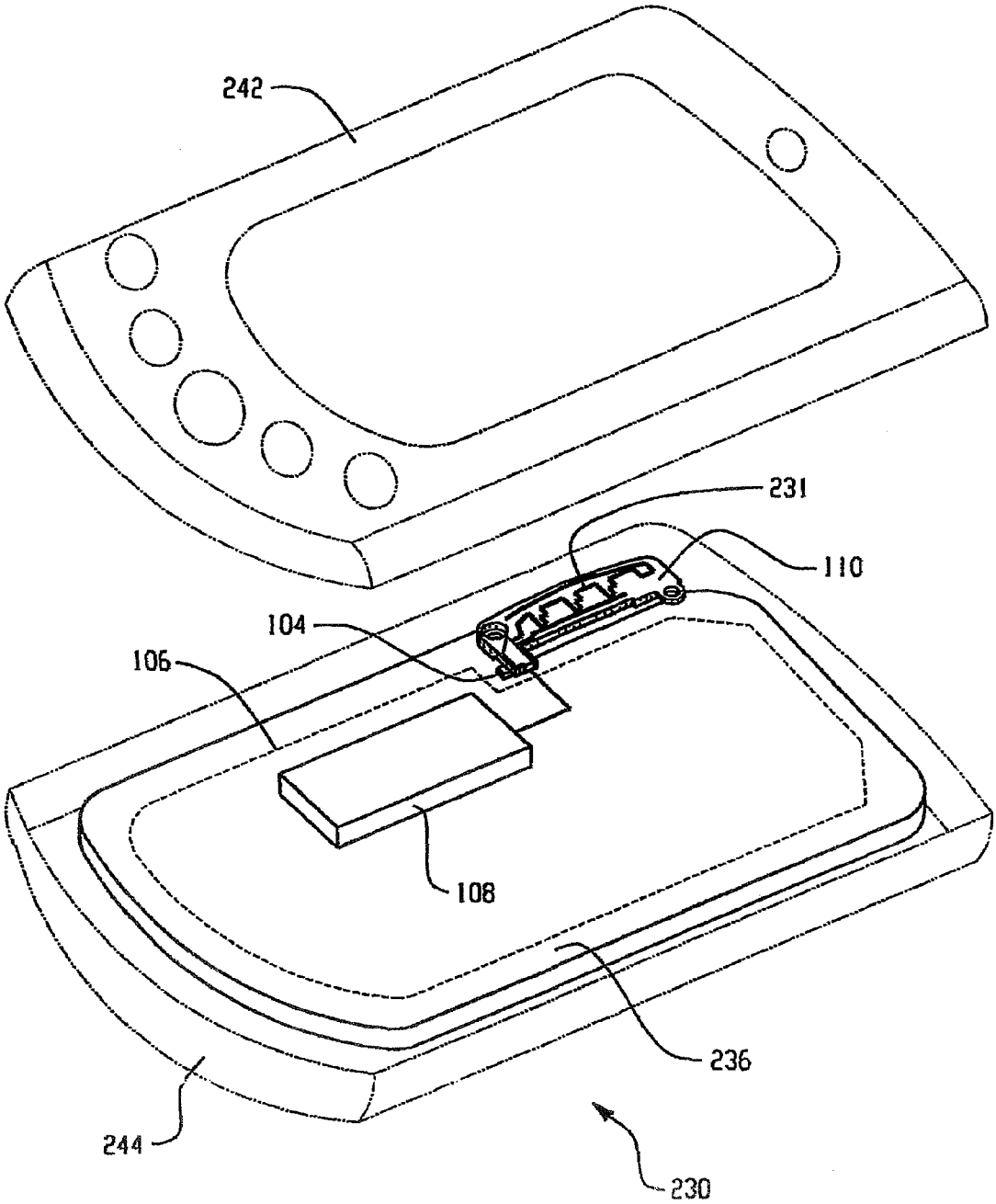
FIG. 14 is an exploded view of an exemplary personal digital assistant (PDA) having a multi-band monopole antenna.

FIG. 14 is an exploded view of an exemplary personal digital assistant (PDA) 230 having a multi-band monopole antenna 231. The PDA 230 includes the multi-band monopole antenna 231 secured to a mounting structure 110, a circuit board 236, and an upper and lower housing 242, 244. Although shaped differently, the PDA circuit board 236 is similar to the circuit board 102 described above with reference to FIG. 10, and includes a ground plane 106, a feeding point 104, and communications circuitry 108. The illustrated antenna 231 is similar to the multi-band monopole antenna shown in FIG. 5, however alternative antenna configurations, as described above with reference to FIGS. 1-9, could also be used.

The multi-band antenna 231 is secured to the mounting structure 110 and coupled to the circuit board 214 as described above with reference to FIGS. 10 and 11. In slight contrast to FIG. 10, however, the PDA circuit board 236 defines an L-shaped slot along an edge of the circuit board 236 into which the antenna 231 and mounting structure 110 are secured in order to conserve space within the PDA 230. The upper and lower housings 242, 244 are then joined together to enclose the antenna 231 and circuit board 236.

This written description uses examples to disclose the invention, including the best mode, and also to enable any person skilled in the art to make and use the invention. The patentable scope of the invention is defined by the claims, and may include other examples that occur to those skilled in the art.

What is claimed:

1. A multi-band mobile communications device comprising:

a first circuit board comprising a ground plane, a feeding point, and communications circuitry, the feeding point being coupled to the communications circuitry;

a multi-band antenna coupled to the communications circuitry and mounted on the first circuit board, the multi-band antenna comprising:

a common conductor coupled to the feeding point;

a first radiating arm coupled to the common conductor; and a second radiating arm coupled to the common conductor;

wherein a projection of a footprint of the multi-band antenna on a plane of the first circuit board intersects the ground plane; and wherein the intersection of the projection and the ground plane is less than fifty percent of the projection.

2. The multi-band mobile communications device of claim 1, wherein a projection of a footprint of the multi-band antenna on a plane of the first circuit board intersects a metallization of the ground plane by not more than fifty percent of the projection.

3. The multi-band mobile communications device of claim 1, wherein the multi-band antenna is laterally offset from an edge of the ground plane.

4. The multi-band mobile communications device of claim 1, wherein the first radiating arm and the second radiating arm are substantially coplanar.

5. The multi-band mobile communications device of claim 1, further comprising:

a second circuit board;

a second housing and a first housing connected by a hinge, the second housing enclosing the second circuit board and the first housing enclosing the first circuit board, the hinge enabling the housings and the circuit boards to be folded together into a clamshell configuration and opened into a communications configuration; and wherein the hinge enables the first circuit board to be electrically coupled to the second circuit board.

6. The multi-band mobile communications device of claim 5, wherein the multi-band antenna is mounted on the first circuit board adjacent to the hinge.

7. The multi-band mobile communications device of claim 5, wherein the multi-band mobile communications device comprises a clamshell-type mobile communications device.

8. The multi-band mobile communications device of claim 1, wherein the multi-band mobile communications device comprises a bar-type mobile communications device.

9. The multi-band mobile communications device of claim 1, wherein a total length of the first radiating arm is selected to tune the first radiating arm to a first frequency band and a total length of the second radiating arm is selected to tune the second radiating arm to a second frequency band.

10. The multi-band mobile communications device of claim 9, wherein the multi-band antenna is laterally offset from an edge of the ground plane.

11. A multi-band mobile communications device comprising:

a first circuit board comprising a ground plane, a feeding point, and communications circuitry, the feeding point being coupled to the communications circuitry;

a multi-band antenna coupled to the communications circuitry and mounted on the first circuit board, the multi-band antenna comprising:

a common conductor coupled to the feeding point;

a first radiating arm coupled to the common conductor; and a second radiating arm coupled to the common conductor;

wherein the first radiating arm has a meandering section extending from the common conductor in a first direction and a substantially-straight section contiguous with the meandering section in a second substantially-opposite direction as the meandering section;

wherein a projection of a footprint of the multi-band antenna on a plane of the first circuit board intersects the ground plane; and wherein the intersection of the projection and the ground plane is less than fifty percent of the projection.

12. The multi-band mobile communications device of claim 11, wherein the multi-band antenna is laterally offset from an edge of the ground plane.

13. The multi-band mobile communications device of claim 11, wherein the first radiating arm and the second radiating arm are substantially coplanar.

14. The multi-band mobile communications device of claim 11, wherein the multi-band mobile communications device comprises a bar-type mobile communications device.

15. The multi-band mobile communications device of claim 11, further comprising:

a second circuit board;

a second housing and a first housing connected by a hinge, the second housing enclosing the second circuit board and the first housing enclosing the first circuit board, the hinge enabling the housings and the circuit boards to be folded together into a clamshell configuration and opened into a communications configuration; and wherein the hinge enables the first circuit board to be electrically coupled to the second circuit board.

16. The multi-band mobile communications device of claim 15, wherein the multi-band antenna is mounted on the first circuit board adjacent to the hinge.

17. The multi-band mobile communications device of claim 15, wherein the multi-band mobile communications device comprises a clamshell-type mobile communications device.

18. The multi-band mobile communications device of claim 11, wherein a total length of the first radiating arm is selected to tune the first radiating arm to a first frequency band and a total length of the second radiating arm is selected to tune the second radiating arm to a second frequency band.

19. The multi-band mobile communications device of claim 18, wherein the multi-band antenna is laterally offset from an edge of the ground plane.

20. A multi-band mobile communications device comprising:

a first circuit board comprising a ground plane, a feeding point, and communications circuitry, the feeding point being coupled to the communications circuitry;

a multi-band antenna coupled to the communications circuitry and mounted on the first circuit board, the multi-band antenna comprising:

a common conductor coupled to the feeding point;

a first radiating arm coupled to the common conductor; and a second radiating arm coupled to the common conductor;

wherein the first radiating arm comprises a space-filling curve extending from the common conductor in a first direction and a contiguous extended substantially-straight section extending from a meandering section in a second direction, the contiguous extended substantially-straight section extending in a substantially-opposite direction as the meandering section;

wherein a projection of a footprint of the multi-band antenna on a plane of the first circuit board intersects the ground plane; and wherein the intersection of the projection and the ground plane is less than fifty percent of the projection.

* * * * *